US005560450A

United States Patent [19]

Kouno

[11] Patent Number: 5,560,450

[45] Date of Patent: Oct. 1, 1996

[54] SELF-SCANNING CHECKOUT DEVICE

[75] Inventor: Mitsunori Kouno, Shizuoka-ken, Japan

[73] Assignee: Kabushiki Kaisha TEC, Tokyo, Japan

[21] Appl. No.: 376,870

[22] Filed: Jan. 23, 1995

[30] Foreign Application Priority Data

Jan. 21, 1994 [JP] Japan ..... 6-005418

[51] Int. Cl.[6] ..... A47F 9/04

[52] U.S. Cl. ..... 186/61; 235/383

[58] Field of Search ..... 186/59, 61, 66, 186/68; 235/383; 312/223.1, 223.2, 223.3

[56] References Cited

U.S. PATENT DOCUMENTS

| | | | |
|---|---|---|---|
| 4,138,000 | 2/1979 | Hartup | 186/59 X |
| 5,019,694 | 5/1991 | Collins, Jr. | 235/383 |
| 5,178,234 | 1/1993 | Sakurai et al. | 186/68 X |
| 5,195,613 | 3/1993 | Kohno | 186/59 |
| 5,316,107 | 5/1994 | Wieschemann et al. | 186/61 |
| 5,343,025 | 8/1994 | Usui | 186/61 X |

FOREIGN PATENT DOCUMENTS

| | | | |
|---|---|---|---|
| 0531265 | 3/1993 | European Pat. Off. | 186/61 |
| 0585732 | 3/1994 | European Pat. Off. | 186/61 |

*Primary Examiner*—Karen Merritt
*Assistant Examiner*—Scott L. Lowe
*Attorney, Agent, or Firm*—Frishauf, Holtz, Goodman, Langer & Chick

[57] ABSTRACT

A self-scanning checkout device includes a stationary scanner for reading an article code affixed to an article, and a cash register disposed adjacent to the stationary scanner, for performing a settlement process based on article codes sequentially supplied from the stationary scanner. The cash register has a printing unit for printing a result of the settlement process. In particular, the cash register has a housing section having an article table which is exposed at a top of the housing section and on which an article whose article code is difficult to read by the stationary scanner is placed. The housing section is provided for receiving the printing unit below the article table and permitting the printing unit to be freely exposed.

8 Claims, 5 Drawing Sheets

SELF-SCANNING CHECKOUT DEVICE

BACKGROUND OF THE INVENTION

1. Field of the Invention

The present invention relates to a self-scanning checkout device to which article codes are input by a customer, instead of the cashier.

2. Description of the Related Art

In recent years, a large number of large-scale stores such as supermarkets introduced various types of checkout devices for speeding up the checkout.

FIG. 1 shows a conventional checkout device. The checkout device has two tables TB1 and TB2 on which a basket BS is placed, a stationary scanner SC disposed between the tables TB1 and TB2 and an electronic cash register CR installed within the reach of a cashier standing in front of the scanner SC as an operator. The scanner SC optically scans and reads an article code affixed to an article in the form of a bar code. The cash register CR performs a settlement process based on article codes read by the scanner SC.

When a customer places the basket BS storing articles to be purchased on the table TB1, the cashier takes out the articles one at a time from the basket BS, causes the scanner SC to read the article code of the article and sets the article into another basket BS which is previously placed on the table TB2 and is first empty. In the settlement process, the cash register CR sequentially registers article data (an article name, a unit price, and the like) corresponding to an article code from the scanner SC as sales data, causes the sales data to be displayed on a cashier display unit DP1 and customer display unit DP2, totalizes all of the sales data items according to the operation of a keyboard KB, and issues a receipt on which the result of totalization containing article names, unit prices, the number of articles, and the total amount is printed by a printer PR. A drawer DW is used to receive cash paid by the customer, and a sub-keyboard SKB is used to input article codes of articles such as bargains or vegetables to which no article code is affixed or articles whose bar code is stained.

However, if a cashier quickly inputs article codes of articles, the display content of the customer display unit DP2 is updated at short cycles, and it becomes difficult for the customer to completely confirm the article names and unit prices of the articles on the customer display unit DP2. Further, at the time of congestion, the cashier cannot afford to arrange the cash received in the drawer DW and check the amount of money, and he or she bears a mental and physical burden since the time waiting for customers' turn for checkout depends only the cashier's operation.

FIG. 2 shows another conventional checkout device capable of eliminating the above drawback. The checkout device has two scanning lanes L1 and L2 which are formed with substantially the same construction as that of the checkout device of FIG. 1 and symmetrically disposed with respect to the cashier CHR. However, the scanner SC of each scanning lane does not have such a sub-keyboard SKB as shown in FIG. 1 and has a switching section SW for instructing the start and end of scanning instead of the sub-keyboard.

A customer CST selects one of the scanning lanes L1 and L2, for example, the scanning lane L1, places the basket BS containing articles to be purchased on the table TB1 on the scanning lane L1 side, and operates the switching section SW to instruct the scanner SC to start scanning. After this, the customer CST takes out the articles one by one from the basket BS, causes the scanner SC to read the article code of the article, and puts the article into another basket BS which is previously placed on the table TB2 and is first empty. After the article codes of all of the articles are input by use of the scanner SC, the customer CST operates the switching section SW to instruct the scanner SC to end the scanning. The cash register CR on the scanning lane L1 side registers article data (an article name, a unit price, and the like) corresponding to each of the article codes sequentially supplied from the scanner SC as sales data, causes the sales data to be displayed on the cashier display unit DP1 and customer display unit DP2, totalizes all of the sales data items according to the operation of the keyboard KB, and issues a receipt on which the result of totalization containing article names, unit prices, the number of articles, and the total amount is printed by the printer PR. As regards the foregoing articles whose article codes are difficult to be input by use of the scanner SC, the cashier CHR receives these articles from the customer CST and then their article codes by using the keyboard KB, for example.

In the checkout device shown in FIG. 2, since the customer inputs the article codes, he or she can confirm the article name and unit price of an article whose article code, on the customer display unit DP2, and then input a code of the next article. The cashier has only to perform an input operation on only the articles received from the customer, his or her burden is greatly eased. Though the cashier has to monitor the customers who input the article codes on the scanning lanes L1 and L2 and carry out an operation of the cash register CR necessary for receiving cash from or giving cash to the customer, it is hardly a burden to the cashier. Therefore, the cashier can afford to arrange the cash received in the drawer DW and check the amount of money even at the time of congestion. Further, since the input operation using the scanner SC is simple, even if a customer performs it in place of a cashier, the time for waiting customers' turn for the checkout is not lengthened so greatly at the time of congestion. When a customer's turn comes, time for the customer to look on the operation of the cashier without doing anything can be shortened by time corresponding to the input operation carried out by the customer. Therefore, a good impression can be given to the customer. In addition, since one cashier is in charge of two scanning lanes L1 and L2, the labor cost can be reduced.

Nevertheless, even the above checkout device has the following drawback. That is, when the customer of one of the scanning lanes tries to hand a cashier an article whose article code is difficult to input using the scanner SC, the cashier cannot receive the article in some cases if the cashier is arranging the cash or checking the amount of money or the cashier is dealing with a customer of the other scanning lane. In such a case, the customer tends to wait until the cashier becomes free. If an article is handed to the cashier, most customers confirm the name and unit price of the article displayed on the customer display unit DP2 according to an article code input by the cashier and do not resume the input operation of article codes before the article is returned to the customer from the cashier. If the input operation is thus interrupted, the checkout speed cannot be increased more greatly than expected.

SUMMARY OF THE INVENTION

An object of the present invention is to provide a self-scanning checkout device capable of preventing a customer and a cashier from reducing in operation efficiency because of articles whose article code is difficult to input by scanning, without degradation in operability in a limited space.

The above object can be attained by a self-scanning checkout device comprising a stationary scanner for reading an article code affixed to an article; and a cash register disposed adjacent to the stationary scanner, for performing a settlement process based on article codes sequentially supplied from the stationary scanner; wherein the cash register includes a printing unit for printing a result of the settlement process, and a housing section having an article table which is exposed at a top of the housing section and on which an article whose article code is difficult to read by the stationary scanner is placed, for receiving the printing unit below the article table and permitting the printing unit to be freely exposed.

According to the foregoing self-scanning checkout device, the article table is provided for placing an article whose article code is difficult to read by the stationary scanner. When the customer encounters such an article during the article code input operation, the customer places the article on the article table. Then, the cashier inputs the article code of the article placed on the article table into the cash register. Even if the cashier is arranging the cash or checking the amount of money or dealing with another customer, for example, the customer can resume the article code input operation immediately after the article is placed on the article table since the customer need not directly hand the article to the cashier. On the other hand, since the cashier does not receive the article directly from the customer, he or she need not interrupt another operation now effected. Further, since the housing section is designed to receive the printing unit below the article table and permits the printing unit to be freely exposed therefrom, a space for the article table does not adversely affect the size of the cash register or the maintenance of the printing unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENTS

There will now be described a self-scanning checkout device according to an embodiment of the present invention with reference to the accompanying drawings.

Figure 1:
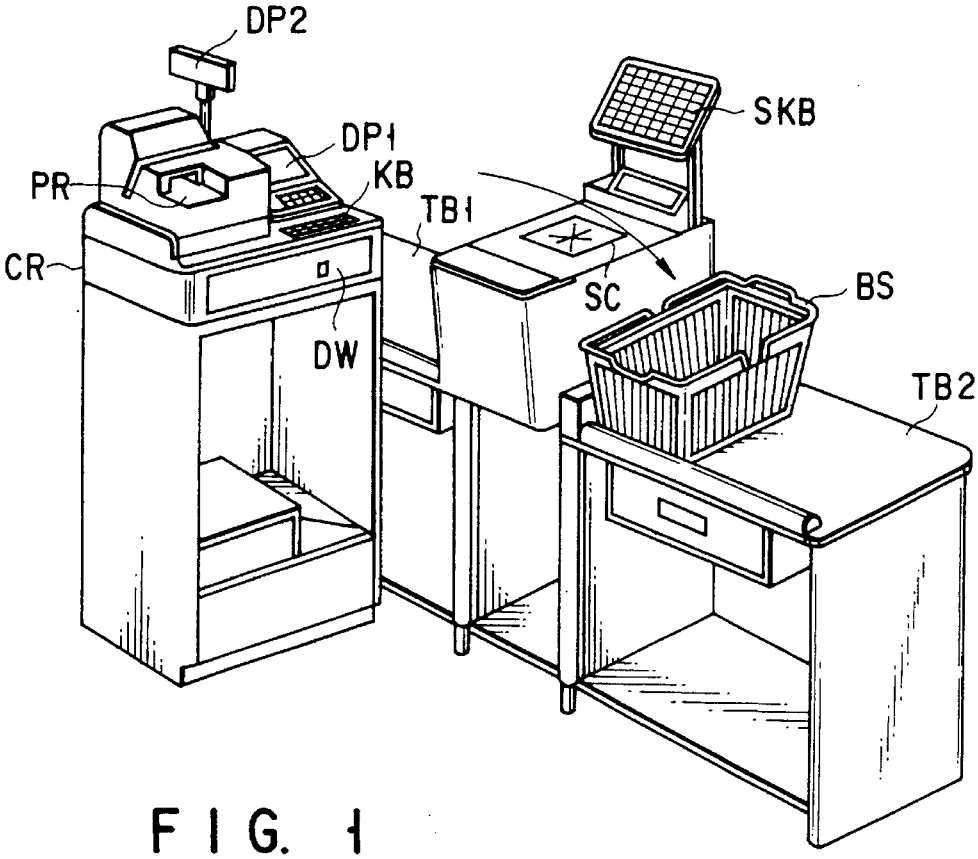
FIG. 1 (PRIOR ART)
FIG. 1 is a perspective view showing a conventional checkout device to which article codes are input by the cashier.
Figure 2:
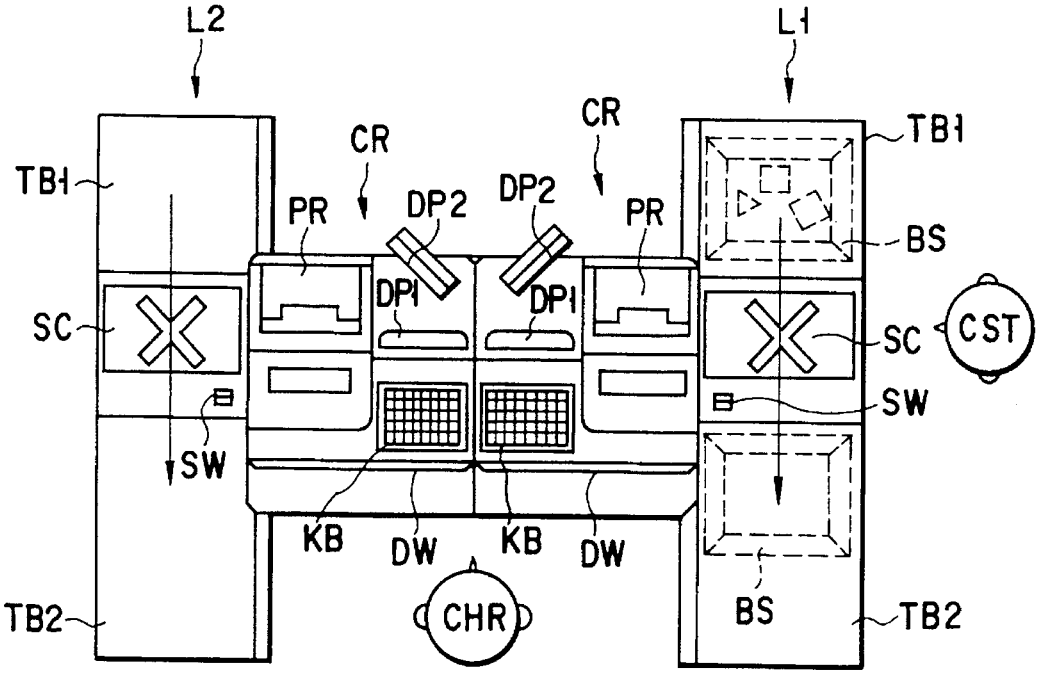
FIG. 2 (PRIOR ART)
FIG. 2 is a plan view showing another conventional checkout device to which article codes are input by a customer.
Figure 3:
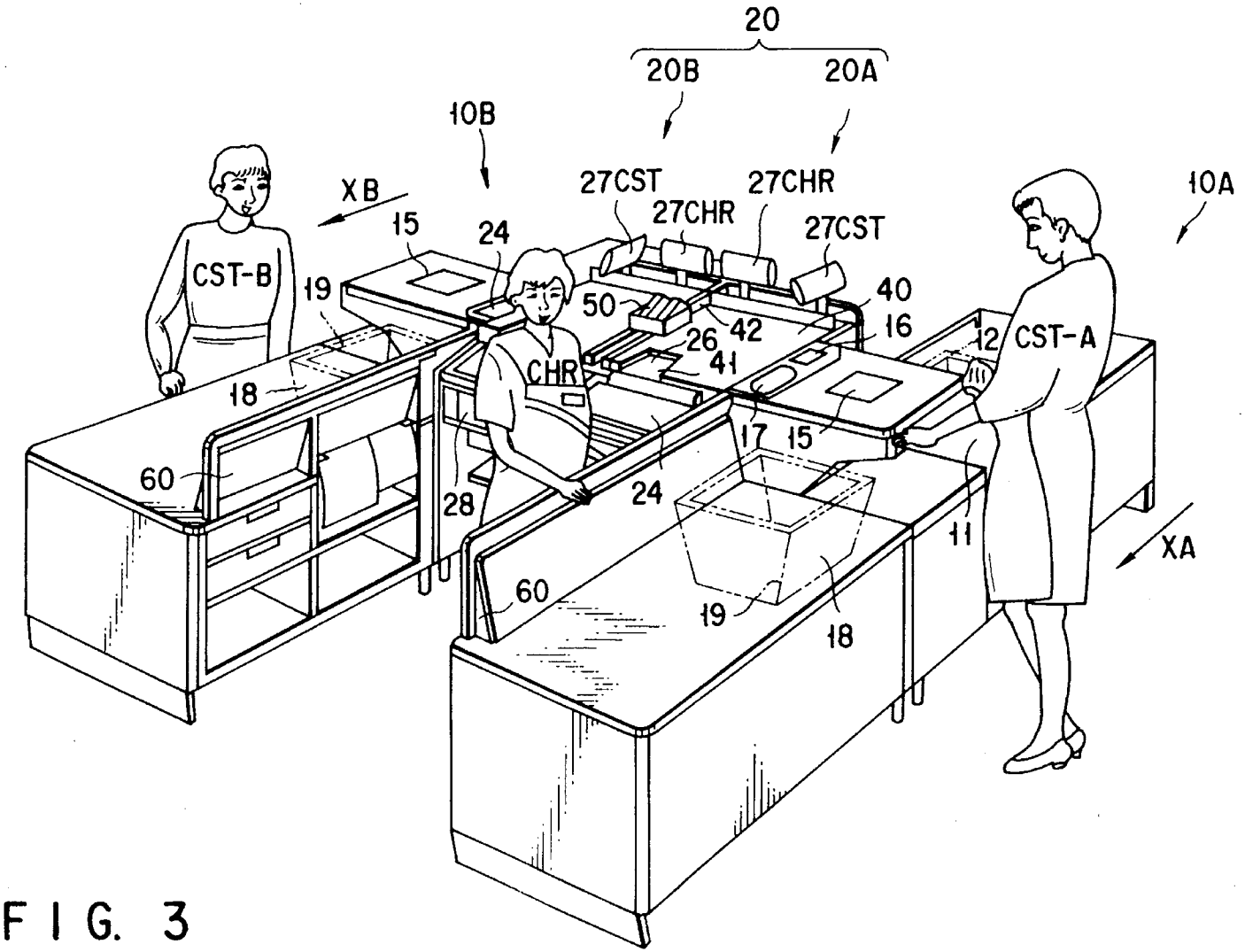
FIG. 3 is a perspective view showing a self-scanning checkout device according to an embodiment of the present invention.

FIG. 3 shows a self-scanning checkout device. The checkout device includes two scanning lanes 10A and 10B arranged in parallel to each other and a settlement section 20 disposed between the scanning lanes 10A and 10B.

Each of the scanning lanes 10A and 10B has a carry-in table 11, stationary scanner 15, and carry-out table 18 disposed on a row. The carry-in table 11 is a table on which a basket 12 containing articles to be purchased by a customer is placed. The stationary scanner 15 is operated by the customer in order to input article codes affixed in the bar code form to the articles contained in the basket 12. The articles sequentially taken out from the basket 12 are optically scanned to read their codes. The carry-out table 18 is a table on which another basket 19 is placed to receive articles whose article codes have been read by the stationary scanner 15. The stationary scanner 15 is disposed between the carry-in table 11 and the carry-out table 18 and has a switching section 16 including instruction keys such as a scanning start key and a scanning end key and a cash tray 17 for temporarily holding cash transferred between the cashier CHR and the customer CST-A (CST-B). The carry-in table 11 and carry-out table 18 are set to be lower than the stationary scanner 15 by an amount corresponding to the depth of the baskets 12 and 19. A partition board 60 is formed on the carry-out table 18 along the one-side end portion thereof which is close to the cashier CHR.

Figure 4:
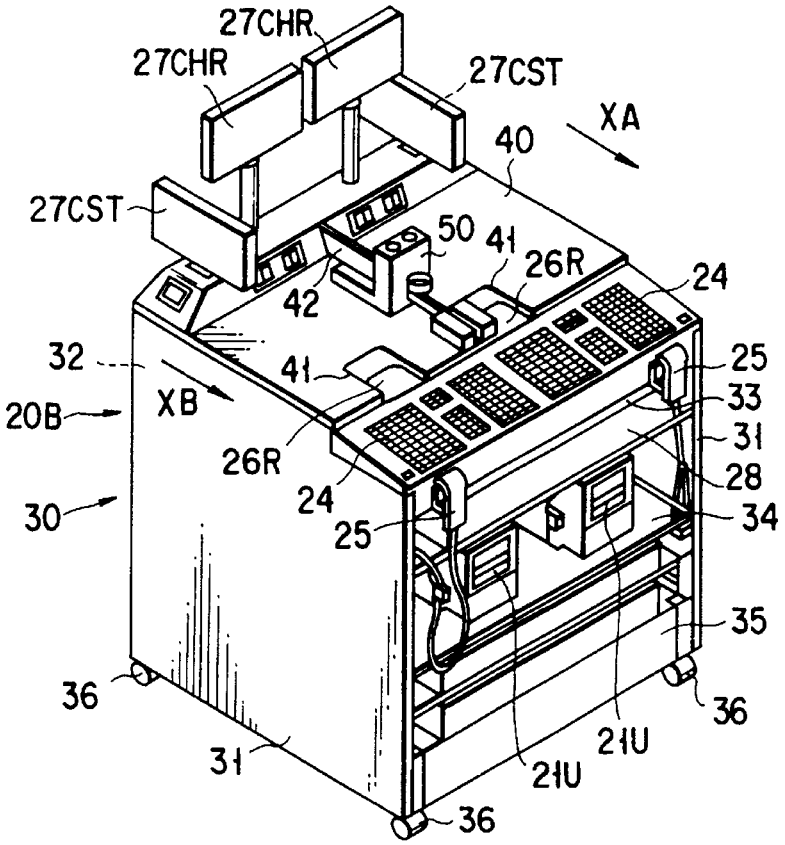
FIG. 4 is a perspective view showing a settlement section of FIG. 3 in more detail.
Figure 5:
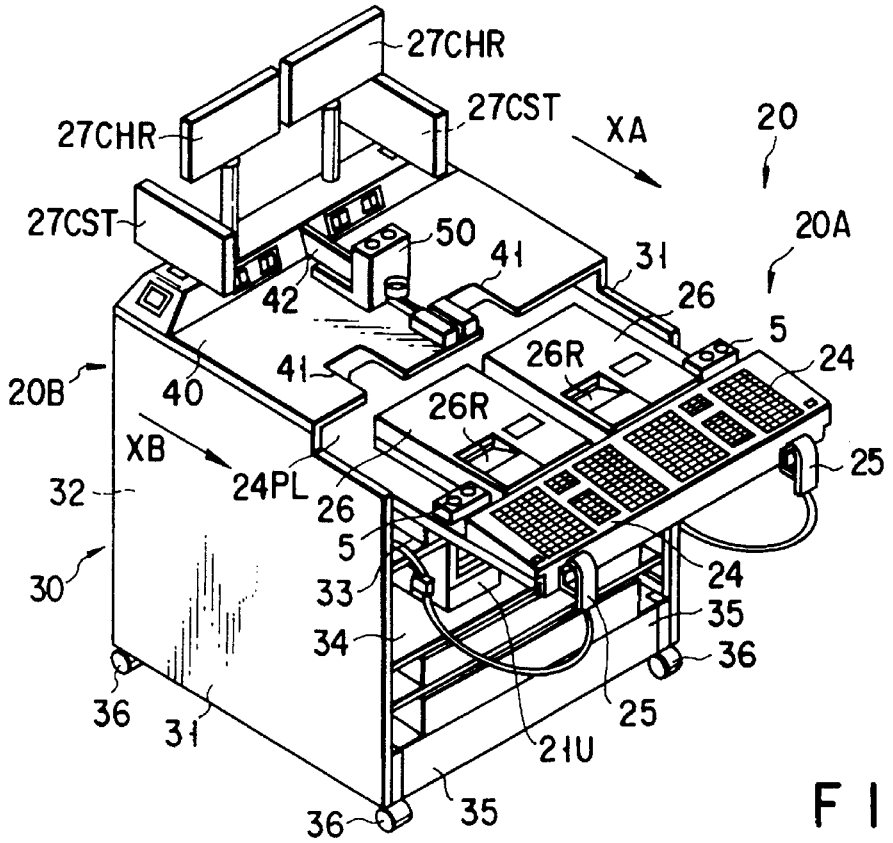
FIG. 5 is a perspective view showing a structure for exposing a printer mounted inside the settlement section shown in FIG. 4 for maintenance.

As shown in FIGS. 4 and 5, the settlement section 20 includes electronic cash registers 20A and 20B which are respectively assigned to the scanning lanes 10A and 10B and operated by the same cashier CHR, a housing 30 for unifying the cash registers 20A and 20B, and a drawer 28 common to the electronic cash registers 20A and 20B. Each of the electronic cash registers 20A and 20B includes a control section 21U, keyboard 24, handy scanner 25, printer 26, cashier display unit 27CHR, customer display unit 27CST, mode switch 5, receipt issuing port 41, and article table 40. The housing 30 is constructed by right and left side plates 31, back plate 32, slide plate 24PL, slide guide plate 33, a plurality of support plates 34, base 35, four casters 36, and partition wall 42. The slide guide plate 33 and support plates 34 are fixed to the right and left side plates 31 and back plate 32. The right and left side plates 31 and back plate 32 are fixed to the base 35. The four casters 36 are mounted on the corners of the bottom portion of the base 35 so as to permit the settlement section 20 to be carried into or carried out from an area between the scanning lanes 10A and 10B. The position of the settlement section 20 is fixed by the braking mechanisms of the casters 36. The slide plate 24PL is mounted on the slide guide plate 33 so as to be drawn from the housing 30 towards the cashier CHR. The components of the electronic cash registers 20A and 20B are symmetrically arranged with respect to the position of the cashier CHR shown in FIG. 3.

In each of the electronic cash registers 20A and 20B, the control section 21U is mounted on the support plate 34. The control section 21U includes a CPU, ROM and RAM, and performs various mode processes including a settlement process for sequentially registering items of article data (article names, unit prices, and the like) corresponding to article codes sequentially supplied from the stationary scanner 15 on the side of the corresponding scanning lane 10A (10B) as sales data items and totalizing all of the registered sales data items. The keyboard 24 is fixed to the slide plate 24PL so as to be exposed at the top of the housing 30 and is operated by the cashier CHR to input article codes and control instructions necessary for the settlement process. The keyboard 24 includes a Tendered/Amount Total key for instructing execution of the account totalization, a plurality of PLU keys for selecting articles such as articles for special sale and vegetables and numerals keys for inputting article codes of various articles. The handy scanner 25 is set on the end portion of the keyboard 24 on the cashier CHR side and is operated by the cashier CHR to selectively read one of the article codes printed on a bar code table sheet in the bar code form for articles such as vegetables and articles for special sale. The printer 26 is fixed to the slide plate 24PL and is used to print the result of totalization obtained for all of the registered sales data items on receipt paper. The cashier display unit 27CHR and customer display unit 27CST are exposed at the top of the housing 30 and are respectively set to face the positions of the cashier CHR and the customer CST-A (CST-B) and display each of the registered sales data items. The mode switch 5 is fixed to the slide plate 24PL near the keyboard 24 to select a process mode of the control section 21U according to the position of the inserted key. The article table 40 is exposed in a portion between the display units 27CHR, 27CST and the keyboard 24, constructs a lid plate of the housing 30, and is used to temporarily hold an article whose article code is difficult to read by use of the scanner 15 on the corresponding scanning lane 10A (10B) side. The article table 40 is set at substantially the same height as the scanner 15 such that a top surface of the article table 40 is coplanar with a top surface of the scanner 15.

The partition wall 42 is disposed on the boundary portion between the article table of the cash register 20A and the article table of the cash register 20B. The drawer 28 is mounted on the support plate 34 and is caused to slide towards the cashier CHR side by the control of each of the control sections 21U of the cash registers 20A and 20B so as to be set into an open state and receive cash which the cashier puts into the drawer.

The slide 24PL is normally set such that the end portion of the keyboard 24 will be set in contact with the end portion of the article table 40. In this condition, the printer 26 and mode switch 5 are disposed below the article table 40 and received in the housing 30. At the time of maintenance of the printer 26, for example, at the time of supply of receipt paper to the printer 26, the slide plate 24PL is drawn as shown in FIG. 5 and the end portion of the keyboard 24 is set in position apart from the end portion of the article table 40. As a result, the printer 26 and mode switch 5 are exposed from the housing 30 (each cash register can be used irrespective of the position of the slide plate 42). The receipt issuing port 41 is an opening formed in part of the article table 40 and permits a receipt supplied from a receipt discharging port 26R of the printer 26 to pass therethrough when the printer 26 is set in the housing 30 and guides the receipt to the cashier CHR side.

Next, an operation of the foregoing checkout device will now be described.

A customer selects one of the scanning lanes 101A and 10B and moves to the selected scanning lane.

The customer CST-A places on the carry-in table 11 the basket 12 containing articles to be purchased in the scanning lane 10A, and depresses the scanning start key of the switching section 16 in front of the scanner 15. By this key operation, the control section 21U of the cash register 20A starts the operation of the scanner 15. The customer CST-A takes the articles out of the basket 12 one by one, and inputs their article codes by use of the scanner 15. The customer CST-A then puts the articles into another empty basket 19 placed on the carry-out table 18. The control section 21U of the cash register 20A sequentially registers article data corresponding to each of the article codes supplied from the scanner 15 as sales data and causes the registered sales data to be displayed on the cashier display unit 27CHR and customer display unit 27CST. After the basket 12 becomes empty, the customer CST-A depresses the end key of the switching section 16. By this key operation, the control section 21U of the cash register 20A stops the operation of the scanner 15. The cashier CHR then depresses the Tendered/Amount Total key provided for execution of the account totalization. The control section 21U thus totalizes all of the registered sales data items, causes the printer 26 to print a receipt indicating the result of totalization containing article names, unit prices, the number of articles, and the total amount, and causes the cashier display unit 27CHR and customer display unit 27CST to display the total amount, and opens the drawer 28. The cashier CHR hands the receipt printed by the printer 26 and issued via the receipt issuing port 41 to the customer CST-A and puts cash paid by the customer CST-A into the drawer 28. The customer CST-A thus completes the checkout, puts all of the articles received in the basket 19 into a shopping bag in a preset place, and then carries the bag.

On the other hand, the customer CST-B performs an operation for inputting the article code by using the scanner 15 on the scanning lane 10B side in the same manner as in the case of the customer CST-A. The cash register 20B performs the same settlement process as that performed by the cash register 20A according to the article codes supplied from the scanner 15 on the scanning lane 10B side. Further, the cashier CHR operates the cash register 20B for the customer CST-B as she does the cash register 20A.

The settlement section 20 performs the settlement processes for the customers CST-A and CST-B in parallel by use of the cash registers 20A and 20B.

Now, assume a case where the articles to be purchased by the customer CST-A include an article such as a bargain or vegetables to which no article code in the bar code form is attached or an article whose article code in the bar code form is stained. Since it is hard for the stationary scanner 15 to read the article code from the above article, the cashier CHR must input the article code of the article. The customer CST-A then places on the article table 40 the article whose article code is difficult to read using the stationary scanner 15. The cashier CHR inputs the article code of the article placed on the article table 40 by means of the keyboard 24 or handy scanner 25 and returns the article to the customer CST-A. The customer CST-A and cashier CHR are able to confirm sales data of an article corresponding to the article code input by the cashier CHR by observing the contents displayed on the customer display unit 27CST and cashier display unit 27CHR.

According to the above embodiment, the article table 40 is provided for each of the cash registers 20A and 20B so as to permit an article whose article code is hard to read by the stationary scanner 15 to be placed thereon. When the customer CST-A or CST-B encounters such an article during the article code input operation, the cashier CHR cannot immediately receive the article in some cases if the cashier is arranging the cash or checking the amount of money or she is dealing with another customer, for example. If, in such a case, the article is placed on the article table 40, its article code is input when the cashier CHR becomes free. Therefore, the customer CST-A or CST-B can resume the article code input operation immediately after the article whose article code is difficult to read by the stationary scanner 15 is placed on the article table 40. That is, the amount of time the article code input operation is interrupted can be shortened. On the other hand, since the article is not directly handed to the cashier CHR from the customer, the cashier is not forced to interrupt another operation which she is effecting. Further, since the housing 30 and slide plate 24PL are designed for receiving the printer 26 below the article table 40 and permitting the printer 26 to be exposed therefrom, a space for the article table 40 does not adversely affect the size of the corresponding cash register or the maintenance of the printer 26.

Further, the display units 27CST and 27CHR, article table 40 and keyboard 24 are arranged in this order in a direction from the upstream side towards the downstream side of the article flow direction XA (XB). This arrangement is more practical than in the following cases (1) to (3).

(1) A case where the article tables are disposed on both sides of the cashier CHR:

In this case, the cashier CHR feels cramped and the customer CST-A (CST-B) must stretch her hand to place an article on the article table.

(2) A case where the article tables are disposed on the upstream side from the display units 27CST and 27CHR:

In this case, the cashier CHR may miss the article placed on the article table and hidden by the display unit 27CST or 27CHR and cannot take the article without being obstructed by the display units 27CST and 27CHR.

(3) A case where the article tables are disposed on both sides of the settlement section 20 between the scanning lanes 10A and 10B:

In this case, the distance between the customer CST-A (CST-B) and the customer display unit 27CST is increased. Consequently, the customer CST-A (CST-B) cannot easily confirm the contents displayed on the customer display unit 27CST. Since, moreover, the distance between the customers CST-A and CST-B is increased, the cashier CHR cannot easily watch the operations effected by the customers CST-A and CST-B in parallel. It is therefore impossible to prevent a dishonesty in which the articles are put in the basket 19 without reading their code.

In the above embodiment, the display content of the customer display unit 27CST is not changed if the article code of the next article is not input by use of the stationary scanner 15. Therefore, the customer CST-A (CST-B) is able to completely confirm the article name, unit price and the like of an article which is identified with each individual input article code on the customer display unit 27CST.

Further, since the receipt issuing port 41 is formed in the article table 40, a receipt can be issued easily and smoothly as compared with the case where a receipt is guided towards the keyboard 24 below the article table 40, and the layout of the printer 26 is hard to restrict on on the slide plate 24PL.

The settlement section 20 can be moved by hand using the casters 36. Therefore, the operation efficiency can be enhanced by adjusting the relationship in relative position between the settlement section 20 and the stationary scanners 15 of the scanning lanes 10A and 10B.

The printer 26 can be exposed simply by drawing the slide plate 24PL towards the cashier CHR. Therefore, the cashier CHR is able to easily and rapidly maintain the printer 26, for example, to supply receipt paper.

The mode switch 5 is usually fixed to the slide plate 24PL received in the housing 30. It is thus possible to prevent the cashier CHR from operating the mode switch 5 erroneously or another person from operating the same without permission.

The present invention is not limited to the above 10 embodiment and can be variously modified without departing from the scope of the subject matter thereof.

As shown in FIG. 3, the baskets 12 and 19 are placed on the carry-in table 11 and carry-out table 18. If no basket is used, these tables can be replaced with a pushcart storage space or a belt conveyer.

Further, it is possible to mount wheels on the bottom surface of the slide plate 24PL and rails on the upper surface of the slide guide plate 33, and vice versa. In this case, the slide plate 24PL can be slid more smoothly than in the case where the slide plate 24PL is directly placed on the slide guide plate 33.

It is preferable that the printer 26 is entirely covered with the article table 40 since more articles can be placed on the table 40. However, the article table can be so designed that its part is exposed from the table 40.

The cash registers 20A and 20B are unified with the single housing 30. However, they can be respectively unified with two separate housings.

Figure 6:
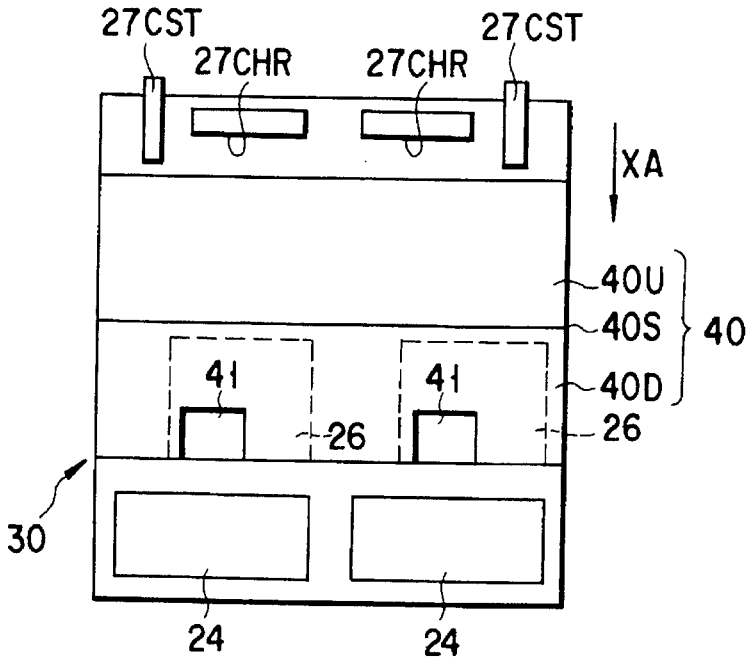
FIG. 6 is a plan view showing a first modification of the settlement section shown in FIG. 4.
Figure 7:
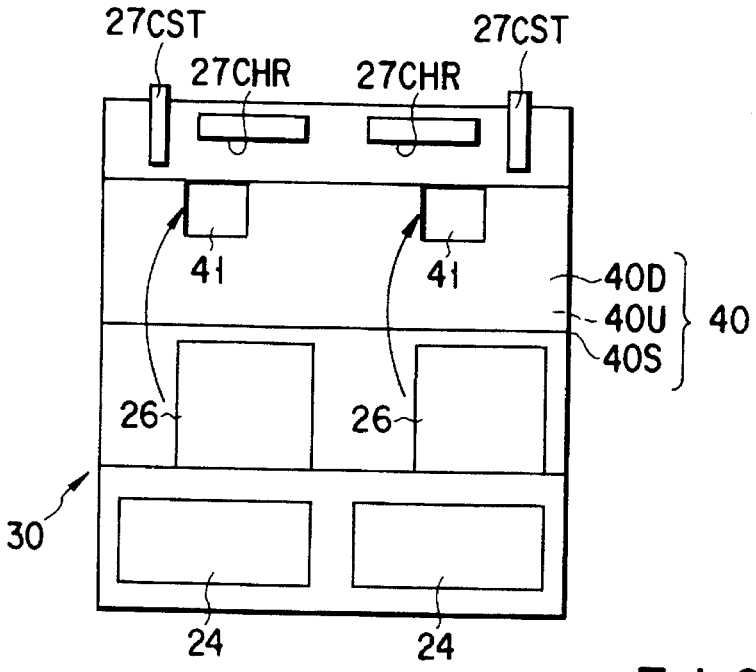
FIG. 7 is a plan view showing a structure for exposing a printer mounted inside the first modification of the settlement section shown in FIG. 6 for maintenance.

The settlement section 20 shown in FIG. 4 can be modified as shown in FIGS. 6 and 7. The modification includes neither the slide plate 24PL nor slide guide plate 33 shown in FIG. 5. The printer 26 and keyboard 24 are fixed to the support plate disposed in the 10 position of the slide guide plate 33. The display units 27CST, 27CHR and the article table 40 are exposed at the top of the housing 30 as in the case of FIG. 4. The article table 40 is constructed by two table plates 40U and 40D and a hinge 40S connecting these table plates. The table plate 40U is fixed to the housing 30 and the table plate 40D is put on the housing 30 as a lid having the receipt issuing port 41. Usually, the table plate 40D is set to be flush with the table plate 40U. At the time of maintenance of the printer 26, the table plate 40D is rotated around the hinge 40S as indicated by arrows in FIG. 6, and set to overlap the table plate 40U. A cellophane tape holder 50 and the partition wall 42 shown in FIG. 4 are moved to other places when the table plate 40D is rotated.

According to the above modification, the printer 26 fixed in the housing 30 can be temporarily exposed. more easily than in the case using the slide plate 24PL used, thereby reducing the manufacturing cost. The article table 40 may be constructed to rotate in a clockwise or counterclockwise direction with respect to the cashier CHR using a hinge extending in the article flow direction XA (XB) or removably mounted on the housing 30.

Figure 8:
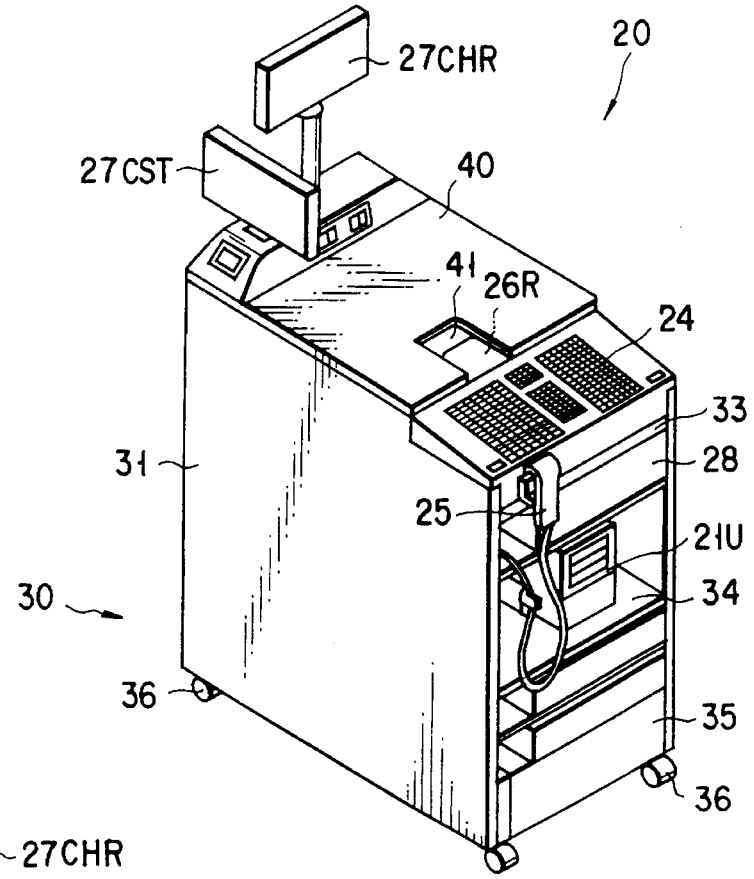
FIG. 8 is a plan view showing a second modification of the settlement section shown in FIG. 4.
Figure 9:
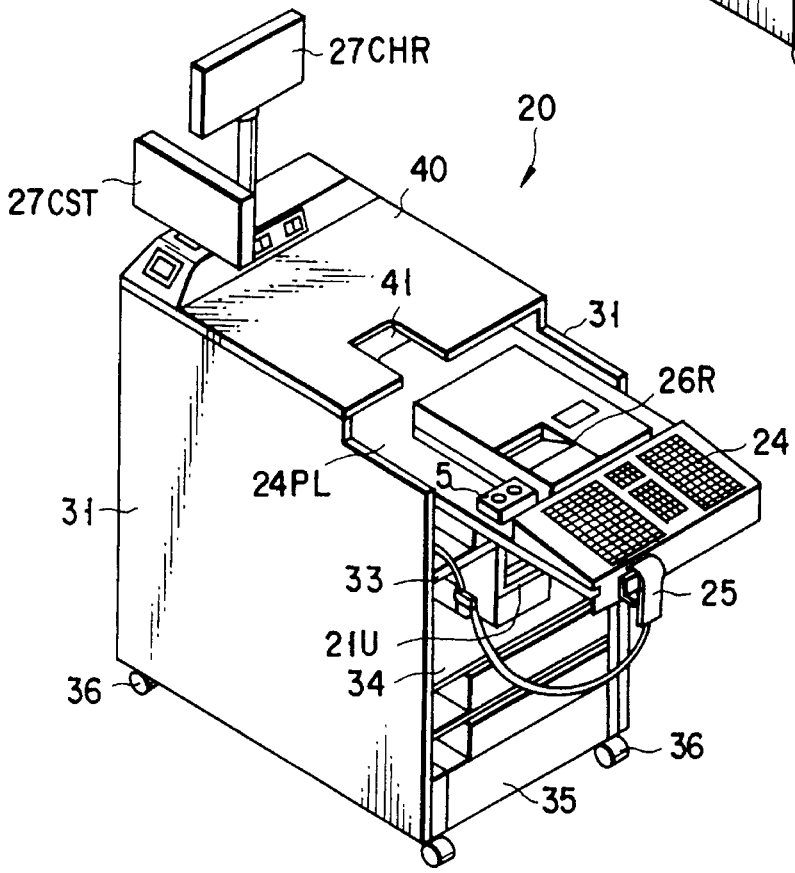
FIG. 9 is a plan view showing a structure for exposing a printer mounted inside the second modification of the settlement section shown in FIG. 8 for maintenance.

Further, one of the scanning lanes 10A and 10B can be omitted. For example, if the scanning lane 10B is omitted, the settlement section 20 is modified to have a single cash register as shown in FIG. 8. In this modification, tile slide plate 24PL is drawn out to expose the printer 26 as shown in FIG. 9. In FIGS. 8 and 9, the same components as those of the above embodiment are denoted by the same reference numerals.

What is claimed is:

1. A self-scanning checkout device comprising:

a stationary scanner arranged to read an article code affixed to an article; and a cash register disposed adjacent to said stationary scanner, for performing a settlement process based on article codes sequentially supplied from said stationary scanner;

wherein said cash register includes a printing unit for printing a result of the settlement process, and a housing section which receives said printing unit, said housing section having an article table which is exposed at a top of said housing section and on which an article whose article code is difficult to read by said stationary scanner is placed, said printing unit being located below said article table and said housing section permitting said printing unit to be freely exposed; and wherein said article table is set flush with said stationary scanner.

2. A self-scanning checkout device according to claim 1, wherein said article table includes a receipt issuing port for passing a receipt on which the result of the settlement process is printed by said printing unit.

3. A self-scanning checkout device according to claim 1, which further comprises:

a second stationary scanner arranged to read an article code affixed to an article; and a second cash register disposed adjacent to said second stationary scanner, for performing a settlement process based on article codes sequentially supplied from said second stationary scanner; and wherein said second cash register includes a printing unit for printing a result of the settlement process, and a housing section which receives said printing unit of said second cash register, said housing section of said second cash register having an article table which is exposed at a top of the housing section of said second cash register and on which an article whose article code is difficult to read by said second stationary scanner is placed, said printing unit of said second cash register being located below said article table of said second cash register and said housing section of said second cash register permitting said printing unit of said second cash register to be freely exposed.

4. A self-scanning checkout device according to claim 3, wherein said housing section of said second cash register is formed integrally with said housing section of said first-mentioned cash register as one component.

5. A self-scanning checkout device comprising:

a stationary scanner arranged to read an article code affixed to an article; and a cash register disposed adjacent to said stationary scanner, for performing a settlement process based on article codes sequentially supplied from said stationary scanner;

wherein said cash register includes a printing unit for printing a result of the settlement process, and a housing section which receives said printing unit, said housing section having an article table which is exposed at a top of said housing section and on which an article whose article code is difficult to read by said stationary scanner is placed, said printing unit being located below said article table and said housing section permitting said printing unit to be freely exposed; and wherein said housing section has a drawable section which holds said printing unit, and wherein said drawable section is drawable from a position where said printing unit is located below said article table.

6. A self-scanning checkout device comprising:

a stationary scanner arranged to read an article code affixed to an article; and a cash register disposed adjacent to said stationary scanner, for performing a settlement process based on article codes sequentially supplied from said stationary scanner;

wherein said cash register includes a printing unit for printing a result of the settlement process, and a housing section which receives said printing unit, said housing section having an article table which is exposed at a top of said housing section and on which an article whose article code is difficult to read by said stationary scanner is placed, said printing unit being located below said article table and said housing section permitting said printing unit to be freely exposed; and wherein said cash register further includes:

a keyboard section for inputting article codes and control instructions necessary for the settlement process; and a display section for displaying a result of the settlement process;

said keyboard section and said display section being exposed at the top of said housing section;

wherein said article table is arranged between said keyboard section and said display section; and wherein said housing section has a drawable section which holds said keyboard section, said printing unit being drawable from a position where said printing unit is located below said article table.

7. A self-scanning checkout device according to claim 6, wherein said article table comprises first and second table plates and a hinge by which said first and second table plates are rotatably connected to each other, and wherein one of said first and second table plates is fixed to said housing section.

8. A self-scanning checkout device according to claim 6, wherein said article table is removably mounted on said housing section.

* * * * *